US005954981A

United States Patent [19]

Deo et al.

[11] Patent Number: 5,954,981

[45] Date of Patent: Sep. 21, 1999

[54] MOUNTING APPARATUS FOR MODULAR RADIANT HEATING ELEMENT

[75] Inventors: Subhash R. Deo, Northport, Ala.; Herbert G. Ray, Columbus, Miss.

[73] Assignee: Emerson Electrict Company, St. Louis, Mich.

[21] Appl. No.: 09/137,245

[22] Filed: Aug. 20, 1998

[51] Int. Cl.[6] ..... H05B 3/68; F24C 15/10

[52] U.S. Cl. ..... 219/455.11; 219/452.11; 126/214 A

[58] Field of Search ..... 219/451.1, 452.11, 219/455.11, 460.1, 461.1, 465.1, 467.1, 468.1, 468.2; 248/300, 301; 126/211, 217, 214 A

[56] References Cited

U.S. PATENT DOCUMENTS

| | | | |
|---|---|---|---|
| 3,086,101 | 4/1963 | Scofield | 219/465.1 |
| 3,406,278 | 10/1968 | Bassett, Jr. et al. | 219/460.1 |
| 3,555,750 | 1/1971 | Banse | 248/300 |
| 3,612,827 | 10/1971 | Dills | 219/460.1 |
| 3,782,757 | 1/1974 | Juergens | 248/300 |
| 4,363,956 | 12/1982 | Scheidler et al. | 219/460.1 |
| 4,755,655 | 7/1988 | Reiche et al. | 219/468.2 |

*Primary Examiner*—Teresa Walberg
*Assistant Examiner*—Sam Paik
*Attorney, Agent, or Firm*—Polster, Lieder, Woodruff & Lucchesi, L.C.

[57] ABSTRACT

A bracket (12) for installing a replacement heating unit (R) in place on a cooktop (C). One leg (14) of each of a pair of L-shaped brackets (12*a*, 12*b*) is attached to the bottom (B) of a pan portion (P) of the heating unit. The pan portion is smaller in diameter than the diameter of the opening in the cooktop where the replacement unit fits. The other leg (16) of each bracket extends upwardly along the side of the pan and is spaced outwardly of the pan. This other end of the bracket fits behind a downturned lip (L) defining an opening (O) in the cooktop in which the replacement unit is fitted. This allows the heating unit, with the brackets attached, to be set in place in the cooktop opening with the upwardly extending legs of the brackets bearing against an inner portion of the opening sidewall so to fit the replacement heating unit in place.

10 Claims, 3 Drawing Sheets

MOUNTING APPARATUS FOR MODULAR RADIANT HEATING ELEMENT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to modular radiant heating units installed on cooktops and the like, and more particularly, to a apparatus for installing such units in place in a secure manner.

In co-pending U.S. patent application Ser. No. 09/073,291, there is described a modular radiant heating unit for use as a replacement for conventional stove top heating elements. The units are plug-in units installed independently of each other; each unit being separately removable and replaceable without effecting any of the other units. The portion of the maintop about each heating unit is typically a surface raised above the rest of the cooktop so utensils set upon a cooking unit are supported slightly above the range top surface. The modular heating unit can also be used as original equipment in new cooktop construction.

Major problems arise when a modular heating unit is used as a replacement is mounting the unit in place. Among these are that the unit must be dimensionally compatible with the opening in the cooktop. The mounting must also be simple enough for a range owner to install the replacement unit without having to make any major modifications to the range. As a practical matter, mounting of the replacement should only require the use of simple tools such as a screwdriver or socket wrench.

BRIEF SUMMARY OF THE INVENTION

Among the several objects of the present invention is the provision of means for installing a replacement modular heating unit in cooktops and the like;

the provision of such a means comprising a bracket or a set of brackets each of which is separately attachable to a pan portion of the heating unit;

the provision of such brackets which further are sized to enable the heating unit to readily fit within an opening in the cooktop where the heating unit being replaced was mounted;

the provision of such brackets which are of a steel or similar strong material so to provide a tight, fit of the repacement unit in the opening;

the provision of such brackets to be quickly and easily attached to the replacement unit by an installer using common tools;

the provision of such brackets which are usable with more than one size replacement heating unit; and, the provision of such brackets which are low cost parts.

In accordance with the invention, generally stated, a means for mounting a replacement heating unit on a cooktop. The means includes a bracket or brackets one end of each of which are readily attached to the bottom of a pan portion of the heating unit. The same size bracket can be used with different sized replacement heating units. The bracket includes a slot so the point of connection of the bracket to the underside of the unit is adjustable. The brackets are L-shaped and are formed of a steel or similar strong material. The pan portion of the replacement heating unit is smaller in diameter than the diameter of the opening in the cooktop where the replacement unit fits. The other leg of the bracket extends upwardly along the underside of the pan and is spaced outwardly of the pan. This allows the heating unit, with the brackets attached, to be set in place in the cooktop opening with the upwardly extending legs of the brackets bearing against an inner portion of a sidewall of the opening so to fit the replacement heating unit in place. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
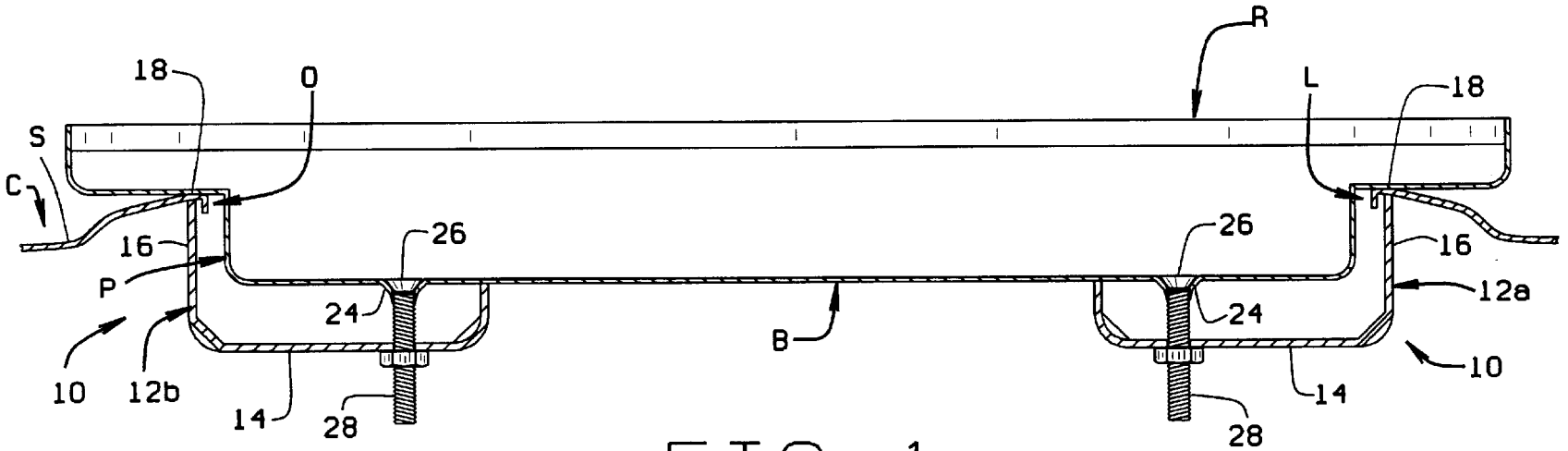
FIG. 1 is a side elevational view, partly in section, illustrating installation of a replacement heating unit in a cooktop using a pair of brackets.
Figure 6:
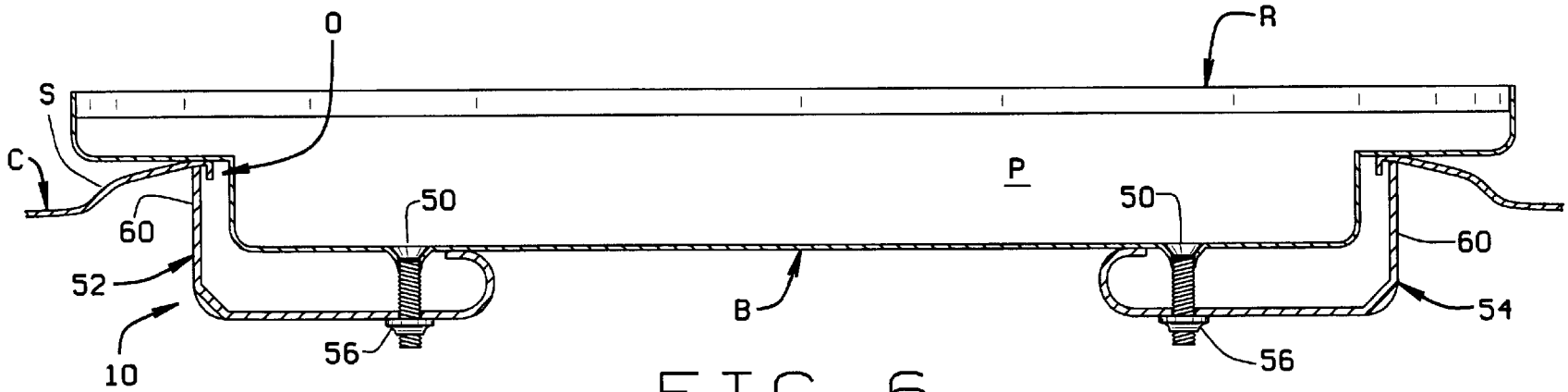
Figure 2:
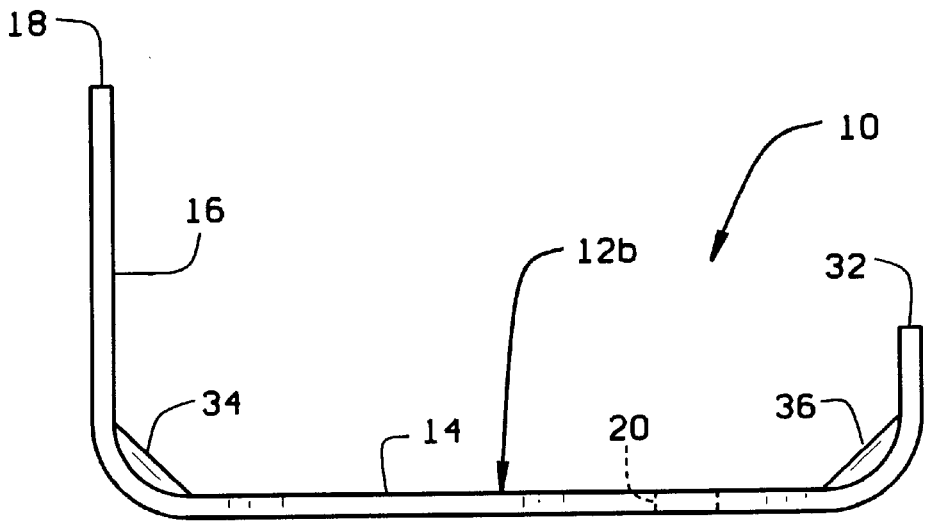
FIG. 2 is a side elevational view of a first embodiment of a mounting bracket.
Figure 3:
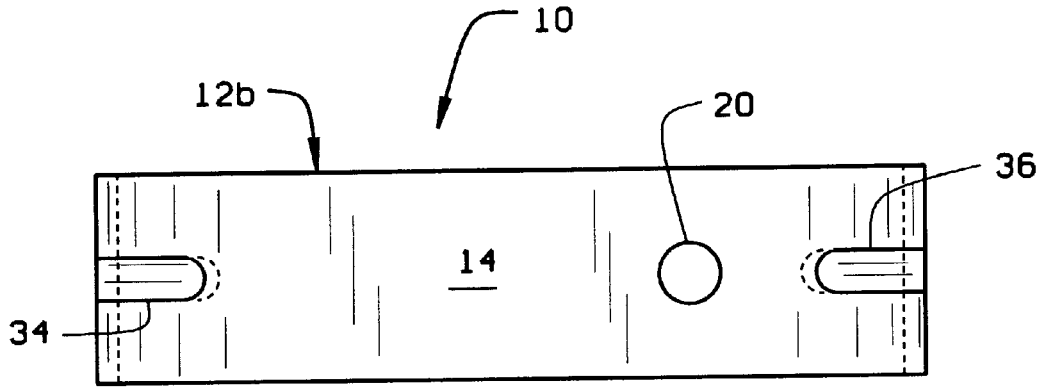
FIG. 3 is a bottom plan view thereof.

Referring to the drawings, a range has a cooktop C in which a plurality of openings O are formed, only one such opening being shown in FIG. 1. A tubular coil type heating unit (not shown) is installed in the opening as original equipment when the range is constructed. In FIG. 1, it is seen that the cooktop has a raised surface S about opening O, so a utensil (not shown) placed upon a heating unit is raised above the cooktop surface. The heating unit is a plug in unit having an electrical connector mating with another connector located at the base of opening O beneath the range top. When the heating unit is replaced, the old unit is disconnected and removed, and a replacement heating unit R is installed in its place. The design and construction of the replacement heating unit is described in the above referenced copending application Ser. No. 09/073,291.

In accordance with the teachings of the copending application, replacement heating unit R is a radiant heater unit which replaces the tubular coil-type heating unit with which the range is normally supplied as original equipment. The replacement unit includes a pan P having a base B. The base portion of the pan has a diameter slightly smaller than the diameter of the opening O into which the replacement unit is fitted. The upper portion of the pan has a diameter larger than that of the opening so when fitted into place, the replacement unit completely covers the opening. Once installed, a heat seal is installed about the upper end of the unit all is described in the copending application.

An improvement of the present invention comprises means 10 for securing the replacement heating unit in place when installed in an opening O. Means 10 includes at least one, and preferably a plurality of brackets 12*a*, 12*b* attachable to the replacement heating unit and securable against a surface (circumferential lip) L defining opening O when the replacement heating unit is fitted thereinto. Each bracket has one leg 14 attachable to the replacement heating unit, and another leg 16 contacting an underside U of the raised portion of the cooktop. The brackets are secured to base B of pan P of the heating units. Brackets 12*a,* 12*b* are generally L-shaped brackets with leg 16 of each bracket being spaced apart from the replacement heating unit when the bracket is attached thereto. This leg extends outwardly of pan P with the outer end 18 of the leg extending behind the lip L.

Figure 4:
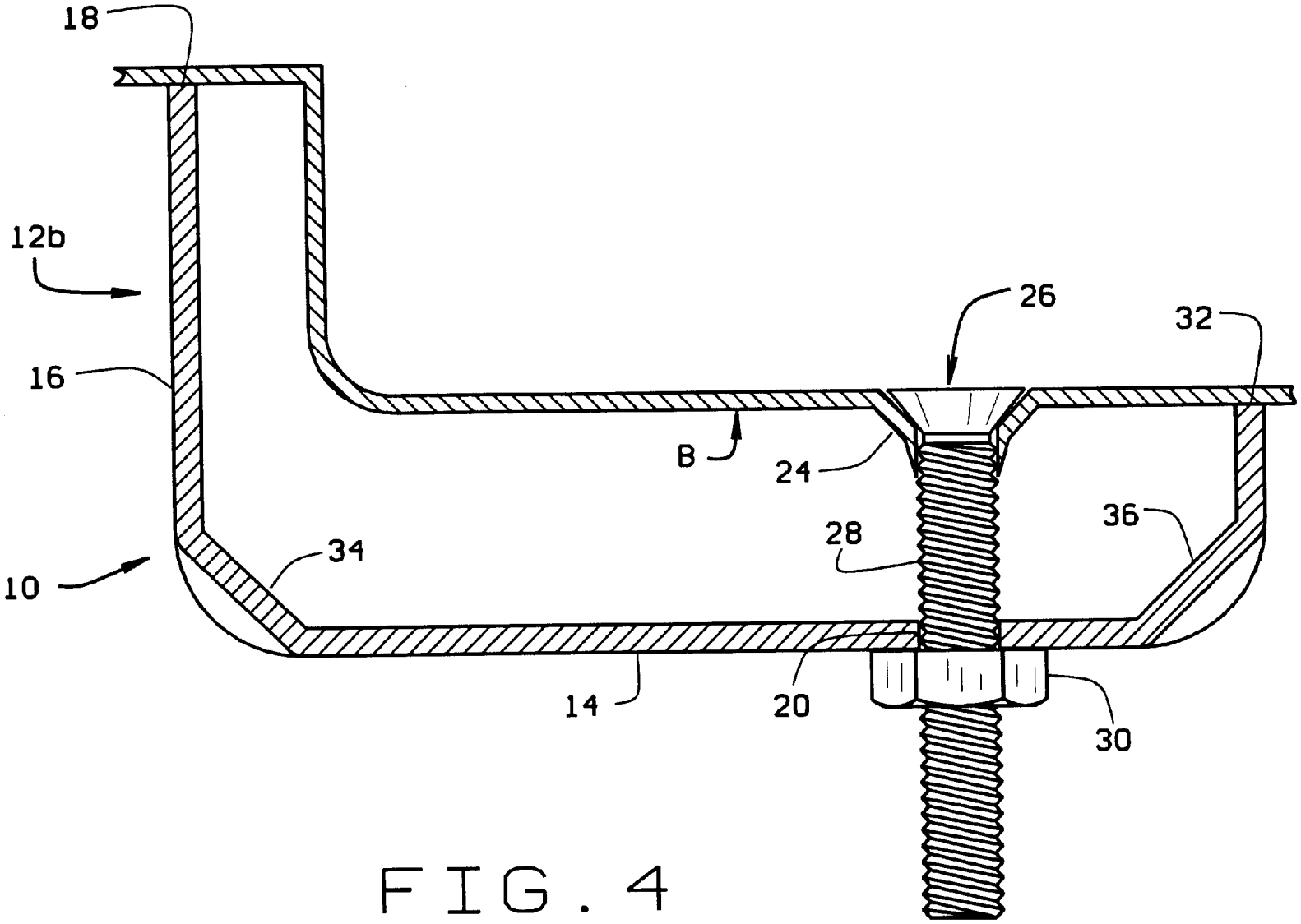
FIG. 4 is another side elevational view of the mounting bracket.

Leg 14 of each bracket extends beneath pan P of the replacement heating unit and is attached to the base of the pan. For this purpose, leg 14 has at least one opening 20 formed therein. As shown in FIG. 4, base B of pan P has an opening 24 through in which a screw 26 is mounted with the threaded shank 28 of the screw extending outwardly of the pan. Opening 20 in each bracket leg 14 is sized to receive the shank portion of the screw. A nut 30 is threaded onto the outer end of the screw to secure the respective brackets in place. The distal end of leg 14 is upturned. When nut 30 is tightened, an outer end 32 of this upturned distal end is drawn against the pan so to bear against base B.

Figure 5:
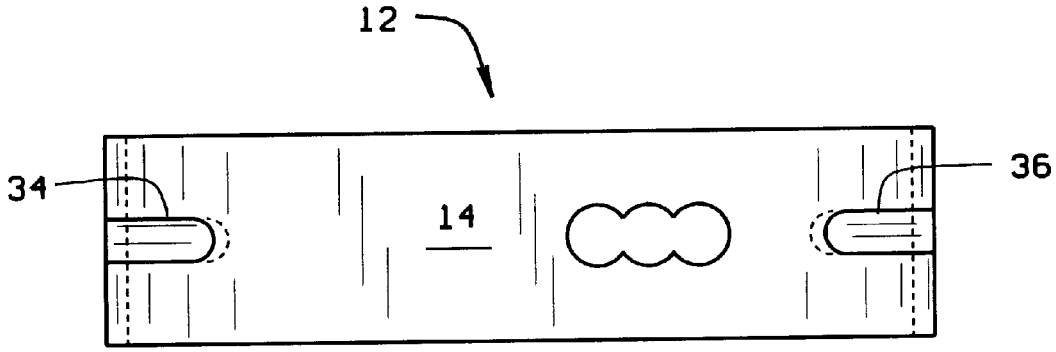
FIG. 5 is a bottom plan view of an alternate embodiment of the bracket; and, FIG. 6 illustrates an alternate embodiment of the invention.

In addition to the other features of the brackets comprising means 10, each bracket further includes strengthening ribs 34, 36 which are formed at the respective bends in the bracket. In addition, and as shown in FIG. 5, the leg 14 of a bracket 12 can have a plurality of adjacent openings 10' formed therein. This allows the bracket to be readily used with different size replacement heating units.

The importance of means 10 is that a key element in the modular heat unit described in the copending application is that it is a field replacement part which can be installed without any modification required to the cooktop. The replacement heating unit is designed as a common component for various cooktop designs that already exist. Thus, the diameter of the pan portion of the heating unit is intentionally kept smaller than the diameter of the smallest cooktop opening. However, the upper portion of the unit is intentionally made larger in diameter than the diameter of the largest cooktop opening so that an annular ring (described in the copending application), when placed over the upper portion of the heating unit, provides a seal about the heating unit and the opening.

For installing the replacement heating unit, power to the range is first turned off. Next, the coil type heater which unit R replaces is removed. The cooktop is now lifted off the range. In many instances, the cooktop is hinged at the rear of the cooktop. The replacement unit is now installed in the opening from which the old heating unit was removed. The brackets 12*a,* 12*b* are now installed. In each instance, opening 20 on leg 14 is fitted onto shank 28 of screw 26. At the same time, leg 16 of the bracket is positioned so to extend behind the downwardly turned lip L defining opening O. When leg 16 is properly positioned, the nut is tightened on the screw to draw the bracket up against the base of the pan. The replacement unit is now firmly in place. Then, the electrical connector (not shown) extending from the base of the pan is connected to the mating connector originally mounted on the rangetop. The cooktop is then lowered back into normal position Power is then turned back on.

It will be understood that means 10 can include other means of mounting the replacement heating unit in place without departing from the scope of the invention. For example, the base of the pan can be provided with two threaded inserts 50 to which L-shaped clamping elements 52, 54 are fixed using nuts or a timmerman clips 56 or the like. The clamps are made of a spring material. One leg 58 of each clamp has a U-shaped end which bears against base B of the pan. The other leg 60 of each clamp now bears against the inside of lip L. The spring legs of the clamps holds them firmly in place against the inside of the cooktop at one end, and the replacement unit pan at the other end.

What has been described is low cost steel or similar metal brackets separately attachable to a pan portion of a replacement heating unit. The brackets are sized to enable the replacement heating unit to fit within an opening in the cooktop, one end of the brackets fitting behind a downtuened lip formed in the cooktop and defining the opening. The brackets are quickly and easily installed using common tools. The brackets are usable with more than one size replacement heating unit.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

We claim:

1. In a replacement heating unit for installation in a cooktop having an opening defined therein in which said replacement heating unit fits, the improvement comprising means securing said replacement heating unit in place when installed in said opening, said means being attachable to said replacement heating unit and securable against a surface defining said opening when said replacement heating unit is fitted thereinto, said means including a pair of brackets each of which has one end attachable to said replacement heating unit and another end contacting an underside of a portion of the cooktop defining said opening, one end of each of said pair of brackets being secured to a pan portion of said replacement heating unit on opposite sides of said heating unit, said brackets being generally L-shaped with one leg of each said bracket being spaced apart from said replacement heating unit when said bracket is attached thereto for said leg to be spaced apart from said pan portion of said replacement heating unit and extend behind a lip defining a sidewall of said opening, each bracket having another leg which extends beneath said pan portion of said replacement heating unit and is attached to said unit, a screw being mounted to a base of said pan portion of said replacement heating unit and said other leg having at least one opening therein sized for insertion of a shank portion of said screw therethrough for said screw to be received in said opening, a distal end of said another leg being upturned with an outer end of said upturned distal end contacting said base when said bracket is attached to said replacement heating unit.

2. The improvement of claim 1 wherein each said other leg of said brackets has a plurality of openings therein sized to receive said screw for said bracket positioning to be adjustable whereby said brackets can used for installation of different size replacement heating units in a cooktop.

3. In a replacement heating unit for installation in a cooktop having an opening defined therein in which said replacement heating unit fits, the improvement comprising a pair of brackets for securing said replacement unit in place when installed in said opening, said brackets each being attachable to said replacement heating unit and securable against a surface defining said opening after said replacement heating unit is fitted thereinto, each bracket being a generally L-shaped with one leg of each said bracket being spaced apart from said replacement heating unit when said bracket is attached thereto for said leg to be spaced apart from said pan portion of said replacement heating unit and extend behind a lip defining a sidewall of said opening, each bracket having another leg which extends beneath said pan portion of said replacement heating unit and is attached to said unit, said other leg having at least one opening therein sized for a shank portion of a screw mounted to a base of said pan portion of said replacement heating unit to be received in said opening, and a distal end of said other leg being upturned with an outer end of said upturned distal end contacting said base when said bracket is attached to said replacement heating unit.

4. The improvement of claim 3 wherein each said other leg of said brackets has a plurality of openings therein sized to receive said screw for said bracket positioning to be adjustable whereby said brackets can used for installation of different size replacement heating units in a cooktop.

5. In a replacement heating unit for installation in a cooktop having an opening defined therein in which said replacement heating unit fits, the improvement comprising a pair of clamps for securing said replacement unit in place when installed in said opening, said clamps each being attached to said replacement heating unit and securable against a surface defining said opening after said replacement heating unit is fitted thereinto, said clamps being generally L-shaped, one leg of each said clamp being spaced apart from said replacement heating unit when said clamp is attached thereto for said leg to be spaced apart from said pan portion of said replacement heating unit and extend behind a lip defining a sidewall of said opening, each clamp having another leg which extends beneath said pan portion of said replacement heating unit and is attached to said unit, a screw being mounted to a base of said pan portion of said replacement heating unit and said other leg having at least one opening therein sized for insertion of a shank portion of said screw therethrough for said screw to be received in said opening, a distal end of said other leg being upturned with an outer end of said upturned distal end contacting said base when said clamp is attached to said replacement heating unit.

6. The improvement of claim 5 in which said clamps are made of a spring material.

7. The improvement of claim 5 wherein each said other leg of said clamps has a plurality of openings therein sized to receive said screw for said clamp positioning to be adjustable whereby said clamps can used for installation of different size replacement heating units in a cooktop.

8. The improvement of claim 5 wherein said other end of each clamp is a curved end with a length of a sidewall portion said other end contacting said base of said pan thereby to increase a surface area of said clamp supporting said replacement heating unit.

9. In a replacement heating unit for installation in a cooktop having an opening defined therein in which said replacement heating unit fits, the improvement comprising means securing said replacement heating unit in place when installed in said opening, said means being attachable to said replacement heating unit and securable against a surface defining said opening when said replacement heating unit is fitted thereinto, said means including a pair of brackets each of which has one end attachable to said replacement heating unit and another end contacting an underside of a portion of the cooktop defining said opening, one end of each of said pair of brackets being secured to a pan portion of said replacement heating unit on opposite sides of said heating unit, said brackets being generally L-shaped with one leg of each said bracket being spaced apart from said replacement heating unit when said bracket is attached thereto for said leg to be spaced apart from said pan portion of said replacement heating unit and extend behind a lip defining a sidewall of said opening, each bracket having another leg which extends beneath said pan portion of said replacement heating unit and is attached to said unit, a screw being mounted to a base of said pan portion of said replacement heating unit and said other leg having a plurality of openings therein sized for insertion of a shank portion of said screw therethrough for said screw to be received in one of said openings for said bracket positioning to be adjustable whereby said brackets can used for installation of different size replacement heating units in a cooktop, a distal end of said another leg being upturned with an outer end of said upturned distal end contacting said base when said bracket is attached to said replacement heating unit.

10. In a replacement heating unit for installation in a cooktop having an opening defined therein in which said replacement heating unit fits, the improvement comprising a pair of brackets for securing said replacement unit in place when installed in said opening, said brackets each being attachable to said replacement heating unit and securable against a surface defining said opening after said replacement heating unit is fitted thereinto, each bracket being a generally L-shaped with one leg of each said bracket being spaced apart from said replacement heating unit when said bracket is attached thereto for said leg to be spaced apart from said pan portion of said replacement heating unit and extend behind a lip defining a sidewall of said opening, each bracket having another leg which extends beneath said pan portion of said replacement heating unit and is attached to said unit, said other leg having a plurality of openings therein sized for a shank portion of a screw mounted to a base of said pan portion of said replacement heating unit to be received in one of said openings for said bracket positioning to be adjustable whereby said brackets can used for installation of different size replacement heating units in a cooktop, and a distal end of said other leg being upturned with an outer end of said upturned distal end contacting said base when said bracket is attached to said replacement heating unit.

* * * * *